US008106325B2

(12) United States Patent
Laurent et al.

(10) Patent No.: US 8,106,325 B2
(45) Date of Patent: Jan. 31, 2012

(54) ELECTRIC CONTROL DEVICE

(75) Inventors: Patrice Laurent, Annemasse (FR); Xavier Drouin, Annemasse (FR)

(73) Assignee: DAV, Creteil Cedex (FR)

( * ) Notice: Subject to any disclaimer, the term of this patent is extended or adjusted under 35 U.S.C. 154(b) by 317 days.

(21) Appl. No.: 12/522,618

(22) PCT Filed: Jan. 16, 2008

(86) PCT No.: PCT/EP2008/050470

§ 371 (c)(1), (2), (4) Date: Sep. 28, 2009

(87) PCT Pub. No.: WO2008/090072

PCT Pub. Date: Jul. 31, 2008

(65) Prior Publication Data

US 2010/0038223 A1 Feb. 18, 2010

(30) Foreign Application Priority Data

Jan. 25, 2007 (FR) ..... 07 00513

(51) Int. Cl.
*H01H 9/00* (2006.01)

(52) U.S. Cl. ..... 200/600; 200/5 A; 200/296; 200/314; 345/174

(58) Field of Classification Search ..... 200/5 R, 200/5 A, 600, 511, 512, 293, 295, 296, 310, 200/313, 314, 341; 341/34; 345/174
See application file for complete search history.

(56) References Cited

U.S. PATENT DOCUMENTS

| | | | | |
|---|---|---|---|---|
| 4,628,408 | A | 12/1986 | Kimura | |
| 4,772,769 | A | 9/1988 | Shumate | |
| 4,791,258 | A * | 12/1988 | Youtz et al. | 200/302.1 |
| 5,115,162 | A * | 5/1992 | Leonard et al. | 310/339 |
| 5,876,106 | A * | 3/1999 | Kordecki | 362/29 |
| 6,621,016 | B2 * | 9/2003 | Ohba et al. | 200/4 |
| 6,628,268 | B1 * | 9/2003 | Harada et al. | 345/173 |
| 6,800,819 | B2 * | 10/2004 | Sato et al. | 200/5 R |
| 6,963,040 | B1 * | 11/2005 | Urman | 200/310 |
| 6,967,299 | B2 * | 11/2005 | Howie et al. | 200/512 |
| 7,057,126 | B1 | 6/2006 | Lin | |
| 7,217,900 | B2 * | 5/2007 | Gama et al. | 200/600 |
| 7,547,119 | B2 * | 6/2009 | Kuwana et al. | 362/294 |

FOREIGN PATENT DOCUMENTS

| | | |
|---|---|---|
| DE | 102 13 095 C1 | 10/2003 |
| GB | 2 201 038 A | 8/1988 |
| JP | 1-130435 A | 5/1989 |

OTHER PUBLICATIONS

International Search Report w/translation from PCT/EP2008/050470 dated Jul. 5, 2008 (4 pages).

Patent Abstracts of Japan; Publication No. 01130435 dated May 23, 1989; Fujitsu Ltd. (1 page).

* cited by examiner

*Primary Examiner* — Michael Friedhofer
(74) *Attorney, Agent, or Firm* — Osha • Liang LLP

(57) ABSTRACT

The invention relates to an touch-surface electric control device (1) comprising a touch-surface sensor (29), a printed circuit board (33), connection means (42) for the electric connection between the touch-surface sensor (29) and the printed circuit board (33), the connections means (42) and the touch-surface (29) being flexible and including a connection tab (67), the touch-surface sensor (29) and the printed circuit board (33) being provided on the opposite faces of a common substrate (31) provided between said sensor (29) and said board (33), characterized in that a side face of the common substrate (31) includes a guiding protrusion (44) for the connection tab (67).

15 Claims, 4 Drawing Sheets

ELECTRIC CONTROL DEVICE

Figure 1:
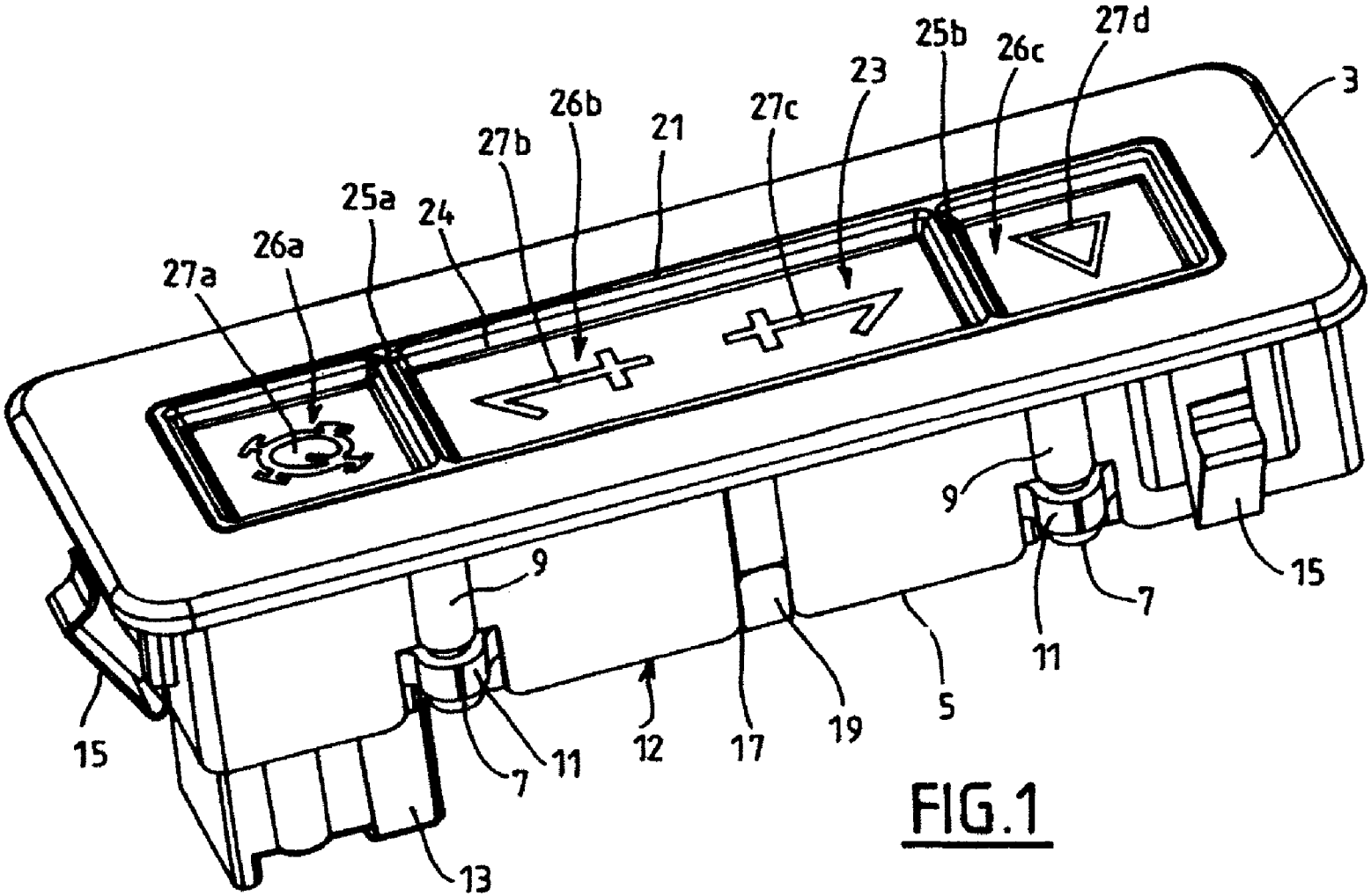

The present invention relates to a touch-surface electric control device, for example a motorized mechanism for opening and/or closing at least one opening, such as a motorized window, a sunroof, a trunk with motorized closure/opening assistance, a motorized tailgate or even a motorized sliding side door. The invention also applies to a touch-surface electric control device for an electronic unit for a multimedia screen or an air-conditioning system.

More recently, it has been proposed to use for these controls touch surfaces making it possible to detect a simple finger pressure on the part of the driver and, depending on the position of the pressure detected and/or the subsequent displacement of this pressure over the surface, to trigger a particular type of action or vehicle unit control. Reference can be made, for example, to the documents FR 2 798 329, FR 2 800 885 and U.S. Pat. No. 6,157,372. These touch surfaces can be of any type and use different technologies.

Thus, for example, the technology which uses pressure-sensitive resistors (also known as force-sensing resistors, FSR) is increasingly outstripping other equivalent technologies, such as, for example, capacitive or even optical technologies, thanks to its ease of implementation and its robustness.

Such sensors are, for example, called "digitizer pads", and the following prior art documents can be cited: U.S. Pat. No. 4,810,992, U.S. Pat. No. 5,008,497, FR 2683649 or alternatively EP 0 541 102.

These sensors comprise semiconductive layers sandwiched between, for example, a conductive layer and a resistive layer. By exerting a pressure on the FSR layer, its ohmic resistance reduces, thus making it possible, by the application of a suitable voltage, to measure the pressure applied and/or the location of the place where the pressure is exerted.

These sensors are incorporated in the control devices by connecting their electric inputs/outputs to a printed circuit board. The printed circuit board is used notably to apply and process the signals from the sensor to determine the position and/or the pressure applied.

However, such control devices are difficult to assemble and manufacture. In particular, the connection between the printed circuit board and the sensor is fragile and vulnerable because of the sensor's fine electrical connections.

The touch surface of the sensor and the electrical connections can then be damaged upon assembly and the functionality of the sensor destroyed or its service life reduced.

The aim of the present invention is therefore to propose an electric control device which makes the control device less fragile and which facilitates its handling in assembly methods.

To this end, the subject of the invention is a touch-surface electric control device comprising a touch-surface sensor, a printed circuit board, connection means providing the electrical link between the touch-surface sensor and the printed circuit board, the connection means and the touch surface of the sensor being flexible and including a connection tab, the touch-surface sensor and the printed circuit board being supported on the opposite faces of a common substrate inserted between said sensor and said board, characterized in that a side face of the common substrate comprises a guiding protrusion for the connection tab.

According to other characteristics of the control device,

- the connection tab is formed by an extension of the touch surface of the sensor,
- the guiding protrusion is formed by at least two parallel fins, the rims of which support the connection tab,

- the rim of each fin comprises a first rounded portion, a second straight portion and a third rounded portion,
- each external fin comprises an external side wall for centering the connection tab,
- the connection means are connected to the printed circuit board by force-fit connectors,
- the connection means are connected to the face of the printed circuit board opposite to the face facing the face of the common substrate,
- the device also comprises removable fixing means for fixing the printed circuit board to one of the faces of the common substrate),
- the removable fixing means comprise means for snap-fitting the printed circuit board to the common substrate,
- the snap-fitting means comprise an oblong hole provided in the printed circuit board and an associated rivet-shaped pin comprising at least one pair of retractable elastic arms, supported by the common substrate,
- the snap-fitting means comprise two side notches provided in the printed circuit board and two associated elastic snap-fitting arms, supported by the common substrate,
- the length of the side notches is greater than the width of the elastic snap-fitting arms of the common substrate so as to allow a sliding motion between the printed circuit board and the common substrate,
- the touch surface of the sensor and the face of the common substrate supporting the touch-surface sensor is transparent or translucent, and in that the face of the printed circuit board facing the face of the common substrate comprises at least one light source, such as a light-emitting diode,
- the height of the common substrate is such that the light emitted by each light source of the printed circuit board forms a light spot of a size greater than or equivalent to the size of an associated pictogram to be illuminated on the touch surface of the sensor, preferably so that the lighting of the pictograms is uniform,
- the touch-surface sensor is an FSR sensor.

Figure 2:
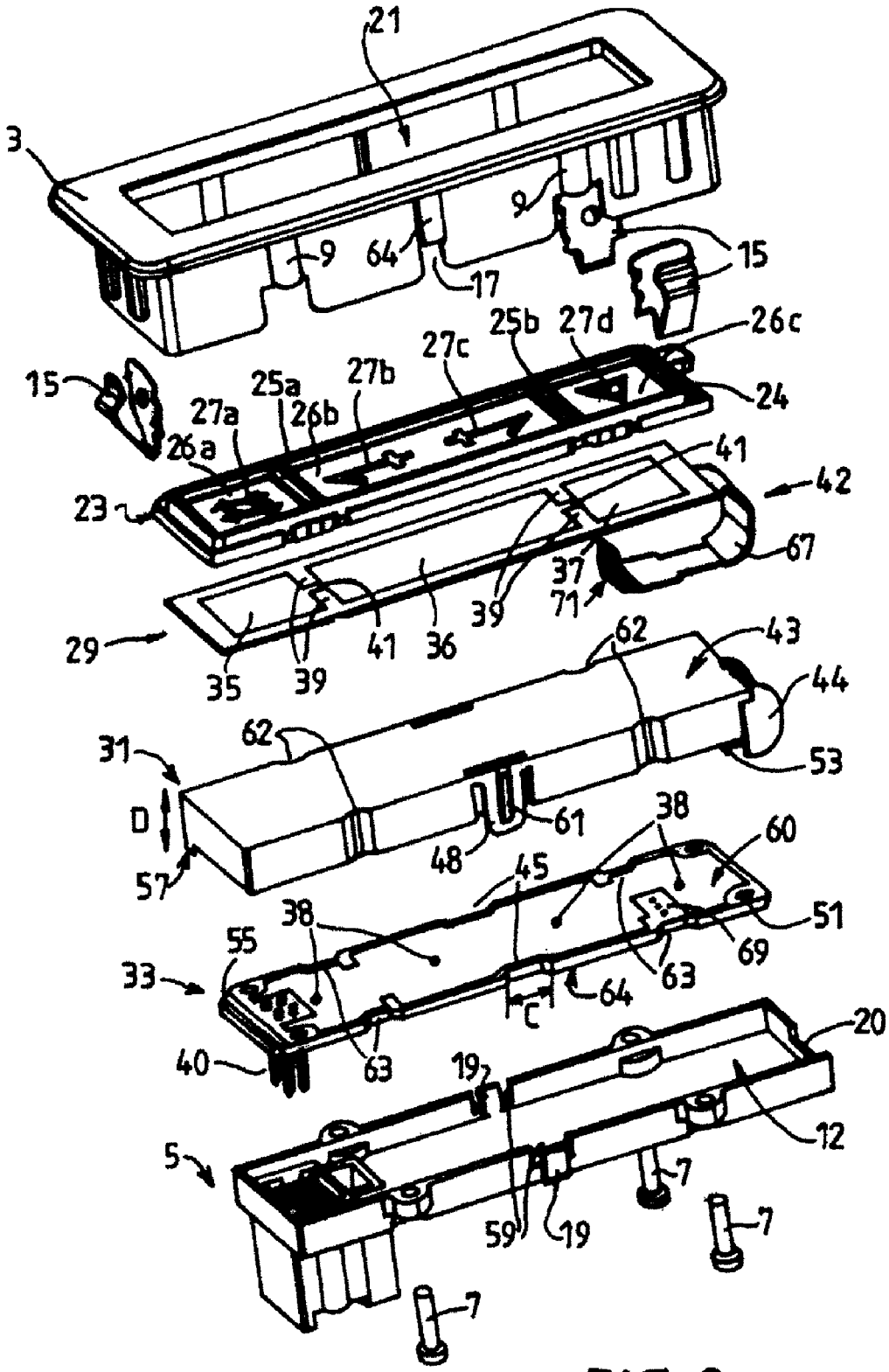
Figure 3A:
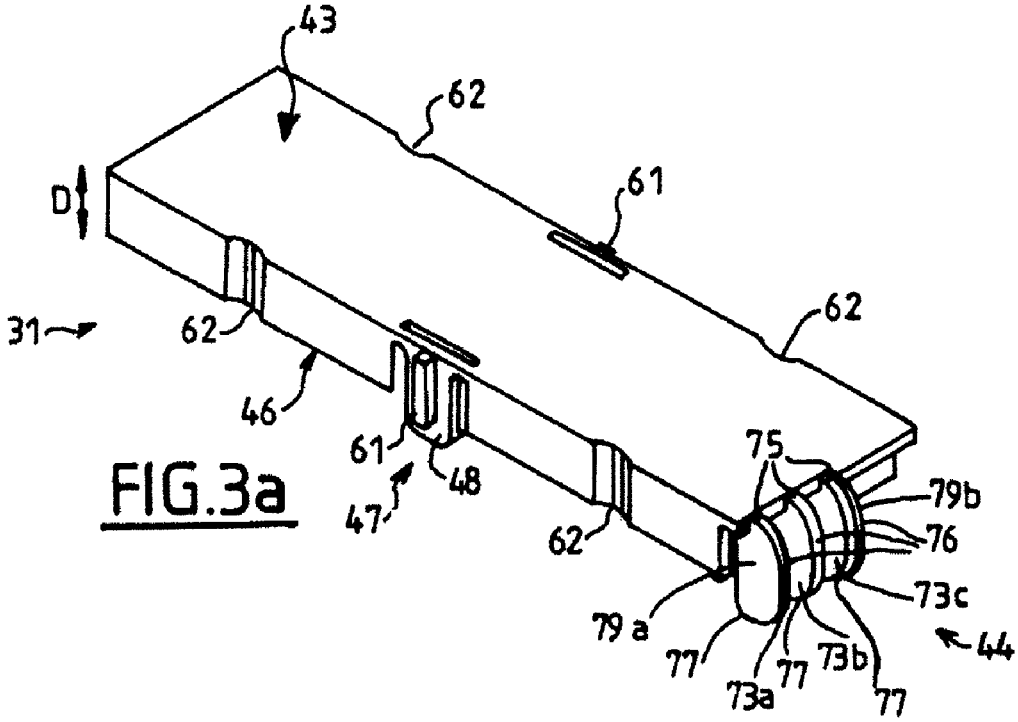
Figure 3B:
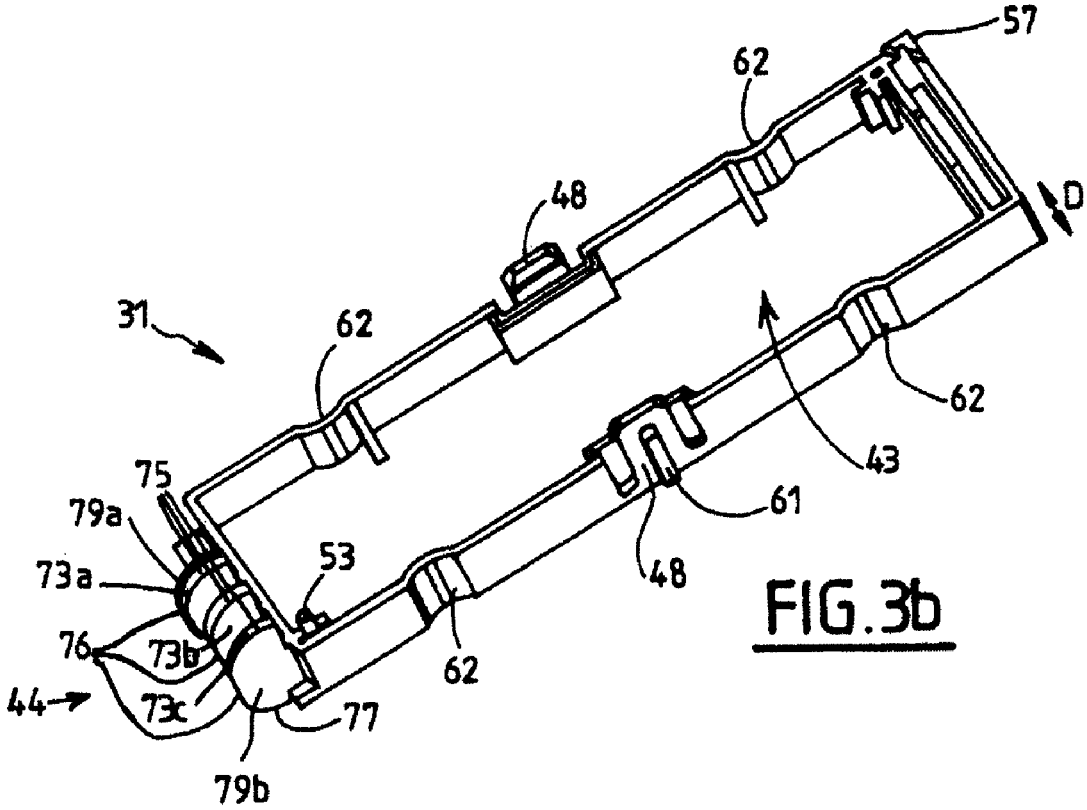
Figure 4:
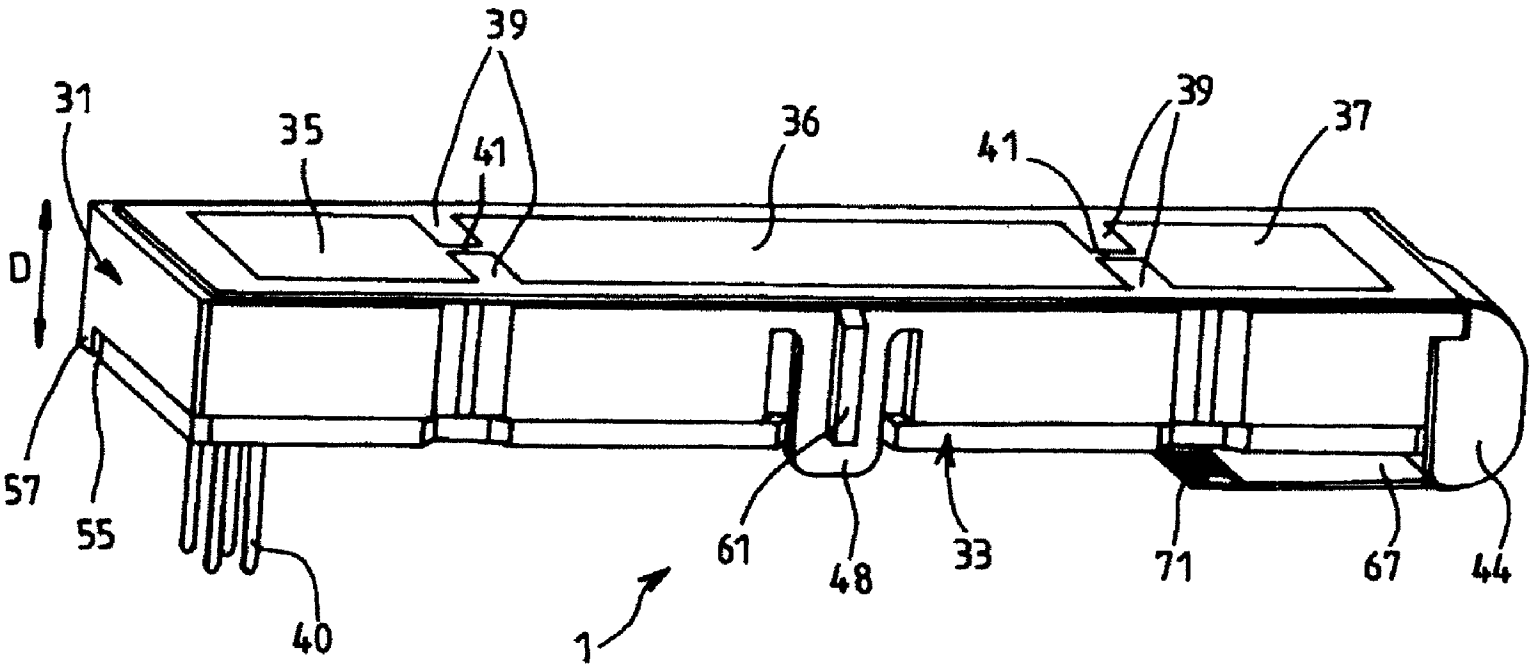

Other benefits and features will become apparent from reading the description of the invention, and the appended drawings in which:

FIG. 1 is a perspective view of the control device according to the invention, incorporated in a casing, FIG. 2 is an exploded perspective view of the device of FIG. 1, FIG. 3*a* is a perspective plan view of an element of the inventive control device, FIG. 3*b* is a perspective bottom view of the element of FIG. 3*a*, FIG. 4 is a perspective view of the assembled control device according to the invention.

In these figures, identical elements are given the same reference numbers.

FIG. 1 shows a control device 1 according to the invention incorporated in a casing. This device 1 is, for example, able to control a motorized mechanism (not represented) for opening and/or closing an opening, such as, for example, a motor vehicle window, a sunroof or alternatively the motorized trunk/tailgate/sliding door of a vehicle.

Obviously, this type of device can be adapted to any other motor vehicle electrical control such as an electric seat control or light controls such as roof reading light or ambient lighting.

The casing, made of plastic material for example, is formed by a lid 3 and a bottom 5 fitting one inside the other and held together by fixing screws 7, such as self-tapping screws, cooperating with associated holes 9 provided on the transversal external faces of the perimeter of the lid 3 after they pass through collars 11 formed in the transversal external faces of the perimeter of the bottom 5 of the casing.

As can be seen on the left in FIG. 1, the bottom part 12 of the bottom 5 of the casing forms a coupling 13 for a male electrical connector for connecting to the motorized mechanism for example.

Snap-fits 15 are inserted on the transversal external faces of the perimeter of the lid 3 of the casing to connect the casing to the vehicle.

Each transversal longitudinal face of the lid 3 includes, in its middle, a centering indent 17 (see also FIG. 2) cooperating with a corresponding rib 19 positioned in the middle of each of the transversal longitudinal faces of the bottom 5 of the casing so as to center the lid 3 on the bottom 5 of the casing on assembly.

An indent 20 (see FIG. 2) can be provided on one of the transversal lateral faces of the bottom 5 of the casing to cooperate with the control device 1, so that there is only one possible direction for assembling the control device 1 on the bottom 5 of the casing.

The lid 3 of the casing includes an opening 21 in which a lining 23 is inserted.

This lining 23 is, for example, a skin, made of an elastic material, preferably of rubber or silicone. Other, more rigid, nonelastic but deformable materials, such as polycarbonate or materials based on a mixture of metal and silicone, can be used. The skin 23 has a peripheral edge 24 and two transversal ribs 25*a*, 25*b* to delimit three active areas 26*a*, 26*b* and 26*c*.

The active area 26*a* can serve as a control to close the opening in "manual" mode. The active area 26*b* is, for example, a "sliding" active area, that is, not only is a finger pressure on the part of the user detected, but also the motion of the pressure, in particular the direction of displacement of a finger of the user for a control to open or close the opening in "automatic" mode. The active area 26*c* can serve as a control to open the opening in "manual" mode.

The active areas 26*a*, 26*b* and 26*c* include pictograms 27*a*, 27*b*, 27*c*, 27*d* which can be etched into the skin 23. Each pictogram 27*a*, 27*b*, 27*c*, 27*d* corresponds to a specific control function. These pictograms 27*a*, 27*b*, 27*c*, 27*d* are translucent, that is to say, they allow light to pass through, relative to the rest of the skin 23 which is generally opaque, which renders the pictograms visible by backlighting which will be described in more detail hereinbelow.

Directly under the lining 23 and enclosed in the casing, the various elements of the control device 1 according to the invention are arranged. These various elements, represented in particular in FIG. 2, comprise a touch-surface sensor 29, a substrate 31 for the touch-surface sensor 29 and a printed circuit board 33.

Preferably, a touch sensor 29 is used that uses pressure-sensitive resistors (also known as force sensing resistors, FSR).

The touch-surface sensor 29 comprises three adjacent active areas 35, 36 and 37 corresponding to the active areas 26*a*, 26*b* and 26*c* to control within these areas the specific electric function described hereinabove.

Preferably, at the level of the transversal ribs 25*a*, 25*b*, the touch surface 29 includes two inactive lateral regions 39, also called dead areas. These dead areas are passed through by passages 41 for the signal from the sensor 29.

The touch surface of the sensor 29 comprises connection means 42 at its end, to provide the electrical link with the printed circuit board 33.

Advantageously, provision is made not only for the touch-surface sensor 29, but also the connection means 42, to be flexible. Thus, it is possible to envisage the connection means 42 being formed by an extension of the sensor 29.

Similarly, it is possible advantageously to provide guidance means such as a guiding protrusion 44 made of a single piece on a lateral face of the substrate 31 to guide the connection means 42, that will be described later.

The sensor 29 is preferably glued to the solid top face 43 of the substrate 31.

The substrate 31, of height D and represented in FIGS. 3*a* and 3*b*, also supports the printed circuit board 33 on its bottom longitudinal face 46, opposite the face 43.

The substrate 31 is thus inserted between the sensor 29 and the printed circuit board 33.

For this, removable fixing means are provided, such as means 47 of snap-fitting the printed circuit board 33 to the substrate 31.

The snap-fitting means 47 can comprise two lateral notches 45 provided on the opposite faces of the sides of the printed circuit board 33 (see FIG. 2) and associated elastic snap-fitting arms 48, supported by the substrate 31.

Advantageously, the length of the lateral notches 45 is slightly greater than the width of the elastic snap-fitting arms 48 of the substrate 31 so that a certain sliding motion over a predefined longitudinal displacement travel (C) is possible between the printed circuit board 33 and the substrate 31.

The elastic snap-fitting arms 48 can advantageously include ribs 61 which cooperate with corresponding centering grooves 64, positioned in the middle of the transversal longitudinal faces of the perimeter of the lid 3 to guide the latter on the control device 1 on final assembly.

According to another embodiment of the invention which is not represented, the snap-fitting means 47 include at least one oblong hole provided in the printed circuit board 33 associated with a rivet-shaped pin comprising at least one pair of retractable elastic arms, supported by the substrate 31.

The pin is inserted into the associated oblong hole. During insertion, end parts of each pair of elastic arms of the pin fit into and engage in the oblong hole.

Returning to FIG. 2, the printed circuit board 33 advantageously includes, on one corner, an oblong hole 51 cooperating with an associated positioning pin 53 supported by the substrate 31 to position the printed circuit board 33 on the substrate 31. The length of the oblong hole 51 corresponds to the predefined displacement travel of the sliding motion between the printed circuit board 33 and the substrate 31.

The sliding motion makes it possible to leave a slight play between the printed circuit board 33 and the bottom 5 of the casing, which then facilitates the assembly of the two parts 3 and 5 of the casing.

It is also possible to provide a chamfer 55 in a corner of the printed circuit board 33, so as to polarize the printed circuit board 33 on the substrate 31 using the associated chamfered part 57 of the substrate 31.

Then, for the substrate 31 to be correctly positioned relative to the bottom 5 of the casing, the latter also includes hollowed-out lateral portions 59 which cooperate with the elastic centering arms 48 of the substrate 31.

To this end, the elastic centering arms 48 of the substrate 31 extend slightly beyond the printed circuit board 33 when the latter is joined to the substrate 31.

Indented portions 62 and 63 can also be provided on the transversal faces of the substrate 31 and the printed circuit board 33 to correspond to the holes 9 provided on the transversal external faces of the perimeter of the lid 3 of the casing to guide the control device 1 in the casing on final assembly.

The printed circuit board 33 (PCB) comprises on the one hand the circuits for power supply and for processing the signals from the sensor 29 and, where appropriate, components for triggering a corresponding specific action. The printed circuit board 33 is used notably to send the signals from the sensor 29 to the communication networks of the vehicle, such as the CAN network.

The top face 60 of the printed circuit board 33 includes at least one light source such as a light-emitting diode 38 for backlighting the control device 1, as will be described in detail hereinbelow.

The printed circuit board 33 also includes, on its bottom face 64, connection pins 40 which plug into the coupling of the male electrical connector 13 of the bottom part 12 of the bottom 5 of the casing.

The insertion of the connection pins 40 of the printed circuit board 33 into the coupling of the male electrical connector 13 also provides a way of guiding the control device 1 in the bottom 5 of the casing.

To make the electrical connection between the printed circuit board 33 and the touch-surface sensor 29, provision is made for the connection means 42 to be formed by a connection tab 67, which is in turn formed by the extension of the touch surface of the sensor 29.

Advantageously, this connection tab 67 is guided by the guiding protrusion 44 formed on a lateral face of the common substrate 31 to be linked to contacts 69 of the printed circuit board 33 by associated force-fit connectors 71 which provide a solderless connection.

Advantageously, the connection tab 67 is connected to the bottom face 64 of the printed circuit board 33, which facilitates assembly.

Once the touch-surface sensor 29 is held in place, preferably by gluing on the solid top face 43 of the substrate 31 and the printed circuit board 33 is snap-fitted to the bottom face 46, it will be understood that the substrate 31 is common both to the touch-surface sensor 29 and to the printed circuit board 33, each being supported by opposite faces of the common substrate 31.

Thus, the control device 1 is obtained, assembled as represented in FIG. 4, easy to incorporate in the casing and avoiding all the drawbacks of the devices of the prior art by proposing a connection between the printed circuit board 33 and the touch-surface sensor 29 without bending the connectors at right angles, and for which the connectors are held in position.

The control device 1 then constitutes a compact and robust production unit, which can be handled independently in the assembly phases of the production methods and for which the prestresses applied to the connectors are limited.

Then, when the control device 1 is assembled on the bottom 5 of the casing, the lining 23 is positioned on the touch surface of the sensor 29 so that the ribs 25*a*, 25*b* on the surface delimit the active control areas 35, 36 and 37.

It is then sufficient to assemble the lid 3 on the bottom 5 of the casing and to fix the screws 7 in the corresponding holes 9 to obtain the control device 1 incorporated in its casing as represented in FIG. 1.

Thus, the protection of the control device 1 is further enhanced. In practice, when incorporated in this way in the casing, there are no extending connections or fragile elements, apart from the connection pins 40 which are themselves protected by the coupling of the male electrical connector 13.

According to the embodiment illustrated by FIGS. 3*a* and 3*b*, it can be seen that the guiding protrusion 44 that guides the connection tab 67 is formed by fins 73*a*, 73*b* and 73*c* arranged in parallel.

Preferably three fins 73*a*, 73*b* and 73*c* are arranged in parallel, so that their rims support the connection tab 67.

The shape of each fin 73*a*, 73*b* and 73*c* is particularly adapted for the connection tab 67 to hug the shape of the guiding protrusion 44 when the connection tab 67 is connected to the printed circuit board 33.

For this, the rims of each fin 73*a*, 73*b* and 73*c* include a first rounded portion 75, which is extended by a second straight portion 76, then by a third rounded portion 77, the angle of curvature of which corresponds to the angle of curvature of the first rounded portion 75.

The rounded portions 75 and 77 are a way of avoiding right-angled connections that could damage the sensor 29.

The height of the straight portions of the fins 76 is chosen relative to the height D of the common substrate 31, of the printed circuit board 33 and of the connectors, the connectors being notably linked to the height of the force-fit connectors 71.

Advantageously, each external fin 73*a*, 73*c* includes an external lateral centering wall-79*a*, 79*b* to prevent the connection tab 67 from being laterally offset on the guiding protrusion 44.

According to a particular embodiment, the backlighting of the pictograms 27*a*, 27*b*, 27*c*, 27*d* is produced by providing light-emitting diodes 38 on the top longitudinal face 60 of the printed circuit board 33 to light the rear face of the solid longitudinal face 43 of the common substrate 31. Preferably, there will be a light-emitting diode 38 for each pictogram 27*a*, 27*b*, 27*c*, 27*d*.

Provision is also made for the face 43 of the common substrate 31 supporting the sensor 29 to be transparent or translucent like the touch surface of the sensor 29 so that the light emitted by the diodes 38 can illuminate the pictograms 27*a*, 27*b*, 27*c*, 27*d*.

The height D of the common substrate 31 is designed such that the light emitted by each cone of emission of each light-emitting diode 38 of the printed circuit board 33 forms a light spot of a size greater than or equivalent to the size of an associated pictogram 27*a*, 27*b*, 27*c* or 27*d* to be illuminated so that the lighting of the pictograms 27*a*, 27*b*, 27*c*, 27*d* is uniform.

It will therefore be understood that the touch-surface electric control device 1 according to the present invention, of which the touch-surface sensor 29 and the printed circuit board 33 are supported by the opposite faces of a common substrate 31, resolves the problems of the prior art. In practice, the common substrate 31 provides a way of obtaining a production unit that can be easily manipulated during the assembly phases.

Furthermore, when the device includes removable fixing means for fixing the printed circuit board 33 to one of the faces of the common substrate 31, the device is also adapted to facilitate the maintenance phases.

Also, when the connection means 42 providing the electrical link between the touch-surface sensor 29 and the printed circuit board 33 and the touch surface 29 of the sensor are flexible, and they are formed by a connection tab 67 such as an extension of the touch surface 29 of the sensor, a lateral face of the common substrate 31 can include a guiding protrusion 44 for the connection tab 67.

The connection between the printed circuit board and the sensor is then protected and reinforced, which reduces the risks of rejection and increases the service life of the electric control devices.

The invention claimed is:

1. A touch-surface electric control device comprising:

a touch-surface sensor, a printed circuit board, connection means providing the electrical link between the touch-surface sensor and the printed circuit board, wherein the connection means and the touch surface of the sensor are flexible and include a connection tab, wherein the touch-surface sensor and the printed circuit board are supported on opposite faces of a common substrate inserted between said sensor and said board, wherein a side face of the common substrate comprises a guiding protrusion for the connection tab.

2. The device as claimed in claim 1, wherein the connection tab is formed by an extension of the touch surface of the sensor.

3. The device as claimed in claim 1, wherein the guiding protrusion is formed by at least two parallel external fins, the rims of which support the connection tab.

4. The device as claimed in claim 3, wherein the rim of each fin comprises a first rounded portion, a second straight portion and a third rounded portion.

5. The device as claimed in claim 3, wherein each external fin comprises an external side wall for centering the connection tab.

6. The device as claimed in claim 1, wherein the connection means are connected to the printed circuit board by force-fit connectors.

7. The device as claimed in claim 1, wherein the connection means are connected to the face of the printed circuit board opposite to the face facing the face of the common substrate.

8. The device as claimed in claim 1, further comprising removable fixing means for fixing the printed circuit board to one of the faces of the common substrate.

9. The device as claimed in claim 8, wherein the removable fixing means comprise means for snap-fitting the printed circuit board to the common substrate.

10. The device as claimed in claim 9, wherein the snap-fitting means comprise an oblong hole provided in the printed circuit board and an associated rivet-shaped pin comprising at least one pair of retractable elastic arms, supported by the common substrate.

11. The device as claimed in claim 9, wherein the snap-fitting means comprise two side notches provided in the printed circuit board and two associated elastic snap-fitting arms, supported by the common substrate.

12. The device as claimed in claim 11, wherein a length of the side notches is greater than a width of the elastic snap-fitting arms of the common substrate so as to allow a sliding motion between the printed circuit board and the common substrate.

13. The device as claimed in claim 1, wherein the touch surface of the sensor and the face of the common substrate supporting the touch-surface sensor is transparent or translucent, and wherein the face of the printed circuit board facing the face of the common substrate comprises at least one light source comprising a light-emitting diode.

14. The device as claimed in claim 13, wherein a height of the common substrate is such that light emitted by each light source of the printed circuit board forms a light spot of a size greater than or equivalent to a size of an associated pictogram to be illuminated on the touch surface of the sensor, so that the lighting of the pictograms is uniform.

15. The device as claimed in claim 1, wherein the touch-surface sensor is an FSR sensor.

* * * * *